US005469190A

United States Patent [19]

Masterson

[11] Patent Number: 5,469,190

[45] Date of Patent: Nov. 21, 1995

[54] APPARATUS FOR CONVERTING TWENTY-FOUR BIT COLOR TO FIFTEEN BIT COLOR IN A COMPUTER OUTPUT DISPLAY SYSTEM

[75] Inventor: Anthony Masterson, Saratoga, Calif.

[73] Assignee: Apple Computer, Inc., Cupertino, Calif.

[21] Appl. No.: 813,147

[22] Filed: Dec. 23, 1991

[51] Int. Cl.[6] ..... G09G 5/04

[52] U.S. Cl. ..... 345/155; 345/202; 395/131

[58] Field of Search ..... 345/153, 154, 345/155, 186, 199; 358/518, 521; 395/131

[56] References Cited

U.S. PATENT DOCUMENTS

| | | | |
|---|---|---|---|
| 4,752,893 | 6/1988 | Guttag et al. | 345/155 |
| 5,003,299 | 3/1991 | Batson et al. | 345/155 |
| 5,081,450 | 1/1992 | Lucas et al. | 345/155 |
| 5,170,152 | 12/1992 | Taylor | 345/155 |

FOREIGN PATENT DOCUMENTS

| | | | |
|---|---|---|---|
| 0359448 | 3/1990 | European Pat. Off. | 345/155 |
| 0413483 | 2/1991 | European Pat. Off. | 345/155 |

OTHER PUBLICATIONS

James D. Foley, "Fundamentals of Interactive Computer Graphics", pp. 600–601.

*Primary Examiner*—Ulysses Weldon
*Assistant Examiner*—Lun-Yi Lao
*Attorney, Agent, or Firm*—Blakely, Sokoloff, Taylor & Zafman

[57] ABSTRACT

Apparatus for converting representations of color pixels in a twenty-four bit color format to representations in a fifteen bit color format including an individual circuit for data representing each component of a color, each of the individual circuits including apparatus for selectively incrementing the value the five highest order bits of a value representing a component of a color, apparatus responsive to a value of the lowest order bits of a value representing a component for providing a signal to cause the apparatus for selectively incrementing the five highest order bits, and apparatus for selectively enabling the apparatus responsive to a value of the lowest order bits depending on a desired pattern of pixels.

13 Claims, 4 Drawing Sheets

APPARATUS FOR CONVERTING TWENTY-FOUR BIT COLOR TO FIFTEEN BIT COLOR IN A COMPUTER OUTPUT DISPLAY SYSTEM

BACKGROUND OF THE INVENTION

1. Field of the Invention

This invention relates to computer output display systems and, more particularly, to methods and apparatus for converting data stored in twenty-four bits per pixel color format into a fifteen bit per pixel color format for storage for display.

2. History of the Prior Art

A typical computer system generates data which is displayed on an output display. This output display is typically a cathode ray tube which produces a number of full screen images one after another so rapidly that to the eye of the viewer the screen appears to display constant motion when a program being displayed produces such motion. In order to produce the individual images (frames) which are displayed one after another, data is written into a frame buffer memory or other similar memory. The frame buffer stores information about each position on the display which can be illuminated (each pixel) to produce the full screen image. For example, a display may be capable of displaying pixels in approximately six hundred horizontal rows each having approximately eight hundred pixels. All of this information in each frame is written to the frame buffer before it is scanned to the display.

In computer systems which display color images, each pixel to be displayed is represented by a number of bits of binary information which define the color of that pixel. In the more advanced systems which handle thirty-two bit words using thirty-two bit registers and buses, twenty-four bits are used to define the color of each pixel, eight bits each to represent the red, green, and blue component values which are combined to produce the final color. Typically, each pixel is stored in one thirty-two bit word space, and the extra eight bits are used for some other purpose or ignored. The memory space required in a frame buffer to store twenty-four bit color where 800 by 600 pixels are to appear in each frame is almost two megabytes. This amount of memory is very expensive, and attempts have been made to reduce it without detracting from the color representation.

One way in which the cost of memory can be reduced is to use a smaller number of bits to represent the color. For example, if five bits are used to represent each of the red, green, and blue components of the color of each pixel, then only fifteen bits are used in total. This easily fits into a sixteen bit half-word length with a single bit left over. Using sixteen bits to store each pixel effectively reduces the size of memory necessary for a frame buffer for any given display size in half. This is a substantial savings. However, for any of a number of reasons, it would be a step back in the computer art to reduce the word size used by the computer system itself. To do so would reduce the ability the computer and is undesirable. Therefore, only the frame buffer memory or other memory used to store display data should be limited to sixteen bit values.

The reduction in the size of the frame buffer memory requires a translation of the pixel color data from a twenty-four bit per pixel representation to a fifteen bit per pixel representation before the data is placed in the frame buffer. The most important question involved in such a reduction in memory size is how to accomplish the reduction while retaining the color authenticity produced by the larger number of bits. The present invention is directed to the solution of this problem.

SUMMARY OF THE INVENTION

It is, therefore, an object of the present invention to reduce the size of the display memory necessary in a computer system capable of displaying color.

It is another more specific object of the present invention to provide a method and apparatus for translating twenty-four bit representations of color pixels into fifteen bit representations while retaining color authenticity.

These and other objects of the present invention are realized in an apparatus for converting representations of color pixels in a twenty-four bit color format to representations in a fifteen bit color format including an individual circuit for data representing each component of a color, each of the individual circuits including means for selectively incrementing the value of the five highest order bits of a value representing a component of a color, means responsive to a value of the lowest order bits of a value representing a component of a color for providing a signal to cause the means for selectively incrementing to increment the five highest order bits, and means for selectively enabling the means responsive to a value of the lowest order bits depending on a desired pattern of pixels.

These and other objects and features of the invention will be better understood by reference to the detailed description which follows taken together with the drawings in which like elements are referred to by like designations throughout the several views.

Notation and Nomenclature

Some portions of the detailed descriptions which follow are presented in terms of symbolic representations of operations on data bits within a computer memory. These descriptions and representations are the means used by those skilled in the data processing arts to most effectively convey the substance of their work to others skilled in the art. The operations are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like. It should be borne in mind, however, that all of these and similar terms are to be associated with the appropriate physical quantities and are merely convenient labels applied to these quantities.

Further, the manipulations performed are often referred to in terms, such as adding or comparing, which are commonly associated with mental operations performed by a human operator. No such capability of a human operator is necessary or desirable in most cases in any of the operations described herein which form part of the present invention; the operations are machine operations. In all cases the distinction between the method operations in operating a computer and the method of computation itself should be borne in mind. The present invention relates to apparatus for operating a computer in processing electrical or other (e.g. mechanical, chemical) physical signals to generate other desired physical signals.

DETAILED DESCRIPTION OF THE INVENTION

Figure 1:
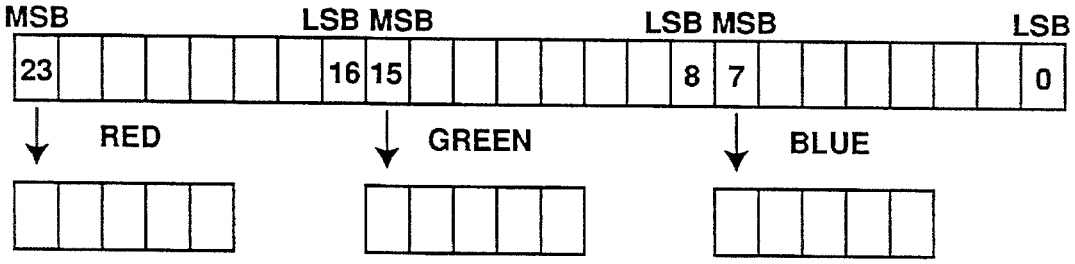
FIG. 1 is a diagram illustrating twenty-four bit and fifteen bit representations of a single pixel to be displayed on an output display.

Referring now to FIG. 1, there are illustrated two different patterns of bits which may represent a single pixel to be displayed on a computer output display. The upper pattern represents the pixel using a total of twenty-four bits of storage. Eight bits are allotted for each of the three red, green, and blue component values which together represent the color of the pixel. The lower pattern represents the pixel using a total of fifteen bits of storage. Five bits are allotted for each of the three red, green, and blue component values which together represent the color of the pixel. In the typical coding utilized to define the three different components which are combined to produce the final pixel color in twenty-four bit color, a fully saturated shade of red is represented when all of the bits of the red component are ones and all of the bits of the green and blue components are zeroes. The absence of any red component is represented when all of the bits of the red component are zeroes. Thus, more red is represented in the color as the eight bits are incremented from all zeroes to all ones. The representations of the two other components perform in the same manner. The least difference between any two shades of red (or the other components) is a value of one in the lowest order bit of the eight bits. In fact, shades represented by variations in the three lowest order bits differ from one another only very slightly.

Consequently, in converting a color pixel from a twenty-four bit format to a fifteen bit format, the least distortion of the shades occur when the three lowest order bits of the eight bits are dropped and the other bits varied in some manner to take account of these dropped bits. For example, the other bits may vary based on the value of the three bits dropped or the location of the pixel on the screen. One method of accomplishing this reduction in the number of bits representing a component of a color is to simply truncate the lowest three bits. Truncation maps eight distinct values for each component in the twenty-four bit format into one value in the fifteen bit format. Using truncation, each component represented in the fifteen bit format may be seven twenty-four bit shades away from the original twenty-four bit shade it represents. Another method is to round up the value of the upper bits if the value of the highest order bit dropped is a one. This produces four distinct component values which are rounded up and four values which are truncated. Although eight twenty-four bit shades are still represented by a single fifteen bit component, no component represents a shade more than three twenty-four bit shades away. We have found that by using both methods and interleaving the truncated and rounded representations produced gives the most satisfying results. This interleaving is an operation typically referred to as dithering.

Figure 2:
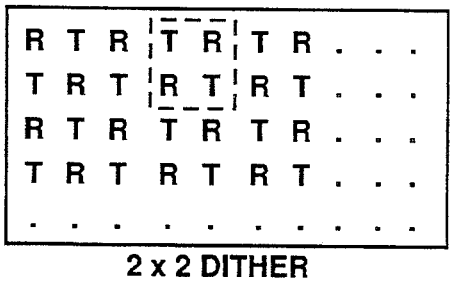
FIG. 2 is a representation of a first scheme for storing pixels for presentation on an output display.

FIG. 2 illustrates a first pattern by which the two representations are interleaved on the output display utilizing the apparatus of the present invention. In the figure, a "R" represents a position in which the component values used to represent the color of a pixel are arrived at by dropping the lowest three bit values and rounding the remaining values; and a "T" represents a position in which the component values used for a pixel are arrived at by simply dropping (truncating) the lowest three bit values. As may be seen in the figure, every other pixel displayed in both the vertical and the horizontal directions is represented by a truncated value while the pixels between are represented by rounded values. This is referred to as a two-by-two dither. The effect of this is that the eye integrates the adjacent pixels and sees a color which is the average of a number of those positions. For example, the eye probably sees the four pixels enclosed by the dotted line in FIG. 2 as a single color. Since this "color" is actually the average of four pixels, it is very similar to the original color provided in twenty-four bit color representation. In fact, it is quite difficult to discern a difference on two displays placed side-by-side, one displaying a twenty-four bit color representation and the other a fifteen bit color representation.

Figure 4:
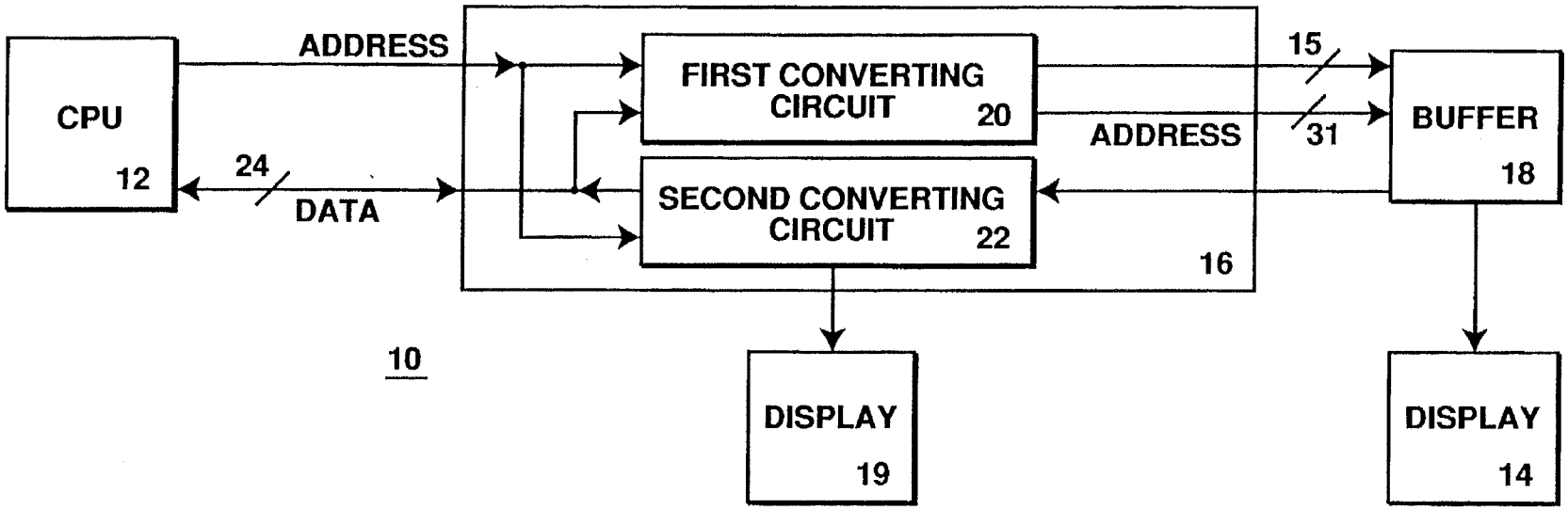
FIG. 4 is a block diagram representing a circuit arrangement for carrying out the present invention.

FIG. 4 is a block diagram of a circuit 10 which may be used in the invention. The circuit 10 includes a central processing unit 12 which in the circuit 10 represents whatever arrangement is used for providing the pixel information which is to be displayed on an output display 14. The central processing unit 12 furnishes address and data to a conversion circuit 16 designed in accordance with the present invention. The conversion circuit 16 first converts the data from the twenty-four bits per pixel format to the fifteen bits per pixel format and then stores the data at the appropriate pixel positions in memory 18 indicated by the address (translated as described hereinafter). The memory 18 is typically a frame buffer constructed of dual-ported video random access memory although other memory such as dynamic random access memory might also be utilized. The frames of pixels held in the memory 18 are transferred to a display 14 if the display 14 is such that it expects to receive data in fifteen bit per pixel format. Such displays are commercially available.

The conversion circuit 16 also is utilized when transferring the pixel data from the frame buffer 18 to the central processing unit 12 or to other circuitry such as a display 19 which expects to receive its data in twenty-four bit per pixel format. The conversion circuit 16 therefore also translates the pixel data from the fifteen bits per pixel format to the twenty-four bits per pixel format. To accomplish these two conversions, the circuitry 16 includes a first circuit 20 for converting the individual red, green, and blue values from eight to five bits and a second circuit 22 for converting the individual red, green, and blue values from five to eight bits.

Figure 5:
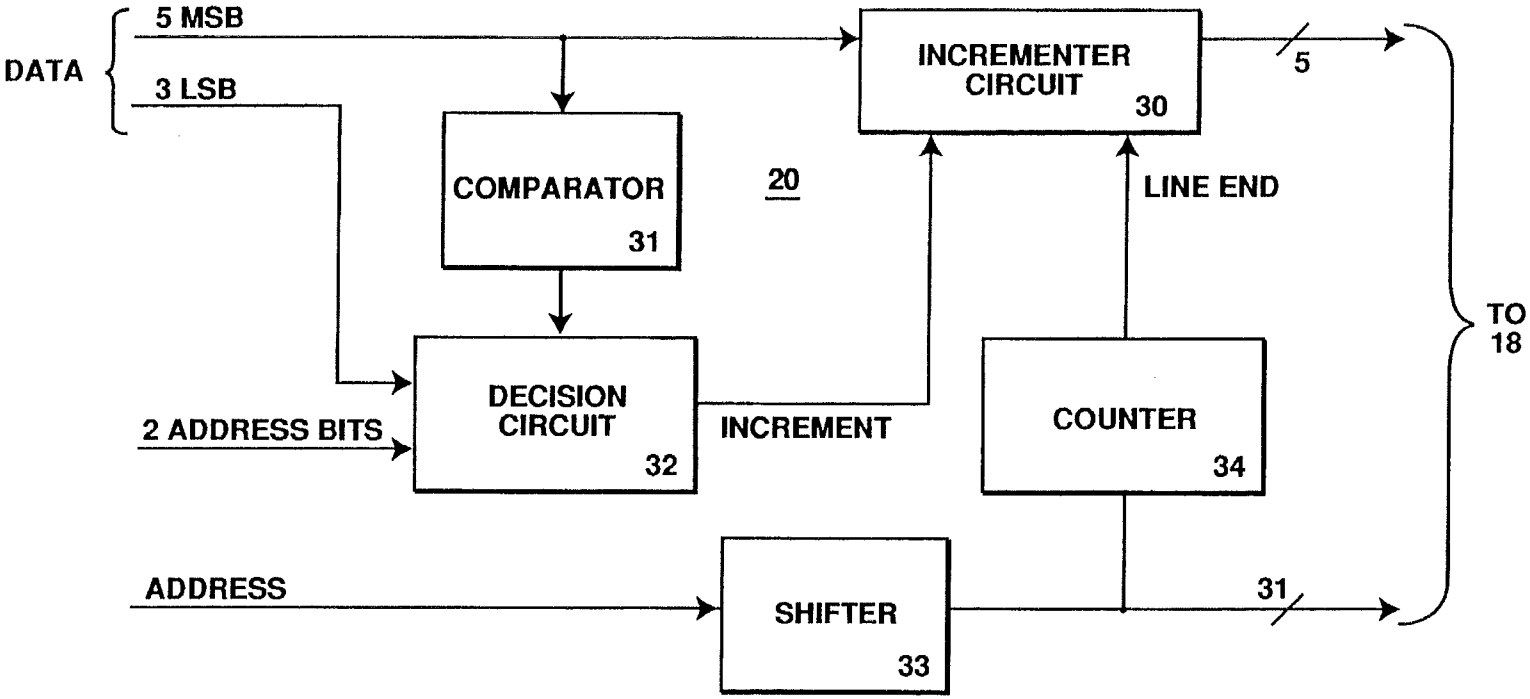
FIG. 5 is another block diagram representing a portion of the circuit arrangement of FIG. 4 for carrying out the present invention.

FIG. 5 illustrates a preferred embodiment of a circuit 20 for translating pixel data in twenty-four bits per pixel format to fifteen bits per pixel format. The circuit 20 illustrated is used to translate only a single component of the three components which determine the color representation, e.g., red. A similar circuit is furnished for providing a similar translation of each of the other color components. The circuit 20 receives in parallel the eight bits of data, and transfers the five most significant bits to an incrementer circuit 30. The incrementer circuit 30 is constructed in a manner well known to those skilled in the art to allow the value of the five most significant bits representing the particular color shade to be selectively incremented by one. A comparator circuit 31 samples the five bits so that if they are all ones a decision is made that no rounding is to occur whatever the condition of the three lower order bits may be. This is necessary in order to keep a saturated value of a component from being translated to all zeroes (a value representing an entire lack of the particular component). The three least significant bits representing the shade are transferred in parallel to a decision circuit 32. The decision circuit 32 utilizes these three bits to determine whether rounding is to occur, where the position of the pixel determines whether rounding or truncation is desired at that position. If the position of the pixel requires truncation, then the three bits are simply discarded.

The determination of the position of the pixel is provided by two lower order bits of the pixel address. In the preferred embodiment of the invention, the two lowest order bits are utilized for sub-pixel addressing (addressing the individual bytes of each pixel) and so are ignored. The next two bits in order determine the pixel position in a sequence of four pixels in the memory which are to be displayed one after another. These address bits are utilized as will be explained to determine the position of the particular pixel in the sequence of pixels so that it may be determined whether rounding or truncation is required. In addition, the decision circuit 32 receives an indication if all of the five higher order bits of color data are ones from the comparator 31, and responds to this by precluding any rounding up whatsoever whatever the position of the pixel in the sequence of pixels.

In the pattern illustrated in FIG. 2, for example, every other pixel on each line is truncated while the other pixels on the line are rounded. Thus, if odd addressed pixels are to have the upper five bits rounded, rounding position is determined by determining whether the lowest address bit sent to the circuit 32 (actually the second to the least significant address bit) is a zero. If the bit is a one, then the pixel falls in an odd numbered address and should be rounded if rounding is necessary (as indicated by the 3LSB input to circuit 32). At this odd numbered position, if the highest bit of the three lowest order bits of data furnished to the circuit 32 is a one and the comparator 31 indicates that the upper five bits are not all ones, then the value of the five bits furnished to the incrementer 30 is incremented by one.

On the other hand, if the lowest address bit sent to the circuit 32 is a zero, then the pixel is directed to an even numbered address and should be truncated. In this case, the five most significant bits are simply transferred by the circuit 30 to storage in memory 18. This has the effect of truncating the values used to produce the three red/green/blue components of every other pixel.

In order to assure that the truncated and rounded pixels alternate in the vertical direction so that striations are not produced on the display 14, each horizontal row has the same odd numbered total of pixels. Thus if the first row stores 821 pixels, the pixel starting the next row will have an even valued address while the pixel starting the third row will have an odd numbered address. A circuit 34 may be positioned to count the number of pixels sent to the memory 18 from the circuit 30 in order to provide a line end signal to accomplish this result. In this manner, the alternating pattern of pixels illustrated in FIG. 2 may be produced. Given that most monitors display an even number of pixels per row, not all pixels on each line will be displayed.

In order to provide appropriate addresses for the pixel values to be stored in the memory 18, the thirty-two bit value of each address used by the processor is simply shifted by one bit to the right by a shifter 33 to provide a thirty-one bit address. Since a sixteen bit address takes half the space of a thirty-two bit address, only half as many addresses are needed. This shifting has the effect of halving the number of addresses in the memory 18.

Figure 6:
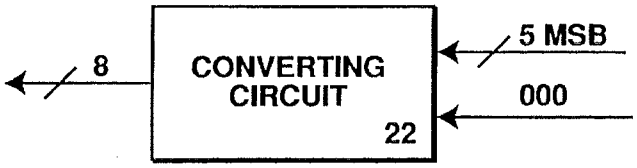
FIG. 6 is another block diagram representing a portion of the circuit arrangement of FIG. 4 for carrying out the present invention.

FIG. 6 illustrates a circuit 22 for translating from the individual shade values in a five bit component per pixel format to an eight bit component per pixel format. Again, this circuit 22 is repeated for each of the component values representing the pixel. The conversion is simply accomplished by concatenating three additional zeroes to the least significant end of the five bits stored for each component of each pixel. In order to access the memory 18 to obtain the five bits of data for each component, the address furnished by the central processing unit 12 or other device seeking the data is again shifted by one bit in the manner explained above with respect to FIG. 5. The data obtained from memory 18 concatenated with the three lowest order zeroes for each color component is then directed to the display or other address depending on the instructions of the system.

Thus, a very simple arrangement produces the desired reduction in memory space to one-half that required by memory for storing a full thirty-two bits of pixel data. Not only is the memory size reduced, but the translation necessary is accomplished on the fly in real time without slowing the operation. The arrangement is not only simple but very inexpensive to implement and allows very accurate emulation of the colors which would be produced were the full twenty-four bits of data to be used.

Figure 3:
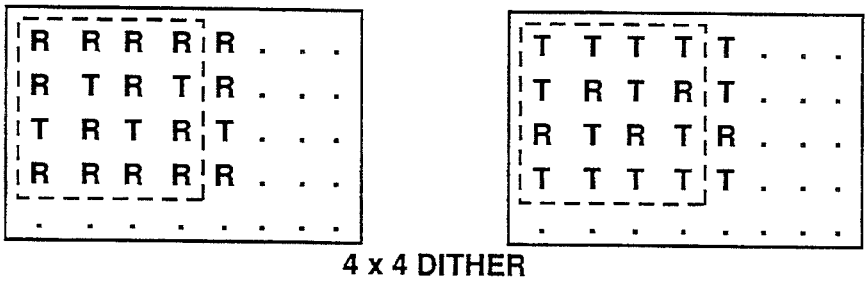
FIG. 3 includes two additional representations of schemes for storing pixels for presentation on an output display.

FIG. 3 illustrates more sophisticated patterns which may be provided by the circuitry of the present invention. In each of these cases, a pattern of four pixels is produced in the horizontal and vertical direction in order to provide different shades. In this case, the eye integrates over sixteen pixels to more accurately represent the color in that area of the display (a four-by-four dither). For example, in the pattern on the left, the pixels of a first line are all rounded (if necessary), those on a second line and a third line alternate as in the pattern of FIG. 2, and those on a fourth line are all rounded. This produces a color that is 75% of the rounded pixel value and 25% of the truncated pixel value, giving a more accurate rendition of an area where the upper two bits of the three least significant bits are mostly ones. A more accurate representation of the actual color values is provided than if the pattern shown in FIG. 2 were the only one used.

In the pattern to the right, on the other hand, the pixels of a first line are all truncated, those on a second line and a third line alternate as in the pattern of FIG. 2, and those on a fourth line are all truncated. This pattern could be used if the color desired using twenty-four bits per pixel is approximately equal to 25% of the rounded pixel value and 75% of the truncated pixel value.

Figure 7:
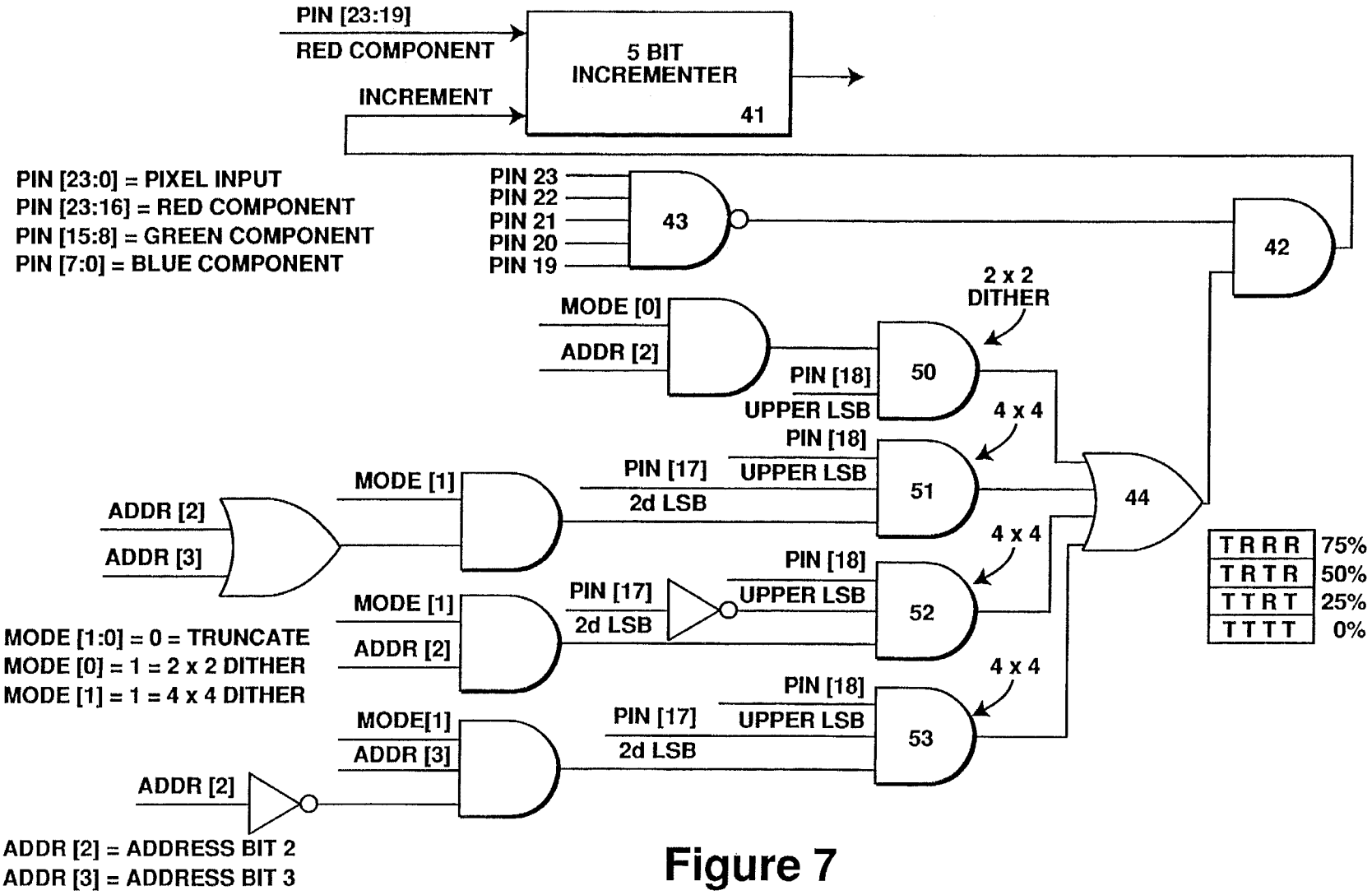
FIG. 7 illustrates a circuit capable of providing a number of different patterns in a fifteen bit color format in accordance with the invention.

FIG. 7 illustrates a circuit 40 capable of providing the patterns similar to those illustrated in the FIGS. 2 and 3. Only the circuit for the red component of the color is shown; however, an identical circuit is used for each of the blue and green components of the color. The circuit includes an incrementer 41 which receives the five high order bits of the eight bit red component value and increments or passes the bits straight through. The decision to increment comes from a first AND gate 42. The AND gate 42 has an input determined by criteria for rounding or truncating and an input from a NAND gate 43. The NAND gate 43 receives the five high order bits of the pixel component. If the five high order bits furnished are all ones, the NAND gate 43 produces a zero; and no signal is allowed on the incrementing input to the incrementer 41. This protects against the rounding of a value which is all ones. Except for this case, the value from the NAND gate 43 to the AND gate 42 is a one so that the value transferred on the increment line to the incrementer circuit 41 is determined by the other input to the AND gate 42.

The other input to the AND gate 42 is received from an OR gate 44 which has four individual inputs, any of which provides an incrementing signal if it is one. One of these inputs functions in two-by-two dither mode which is enabled when a mode [0] is a one value, while the other three inputs function in four-by-four dither mode which is enabled when a mode [1] is a one value. Mode [0] is that illustrated in FIG. 2 in which truncation and rounding alternate. Mode [1] is a mode in which a pattern of four successive pixels are repeatedly described to produce coverage at the same levels as in are illustrated in FIG. 3. Two-by-two dither mode refers to the fact that the dither operation is applied to a two-by-two grid of pixels, while four-by-four dither mode refers to a dither operation over a grid of four pixels by four pixels. Either of the two modes may be selected by providing a one signal. A zero signal for that mode disables the mode. This will produce a pattern of truncated pixels if both modes are disabled together.

In order to obtain the coverage of the patterns illustrated in FIGS. 2 and 3, the address bits and the three least significant order data bits are selectively furnished to AND gates 50–53 which provide the input signals to the OR gate 44. If the circuitry is placed in mode [0] (two-by-two dither mode) by a one value, the address bit two is a one (indicating an odd address) and the upper bit of the low order three bits of the red component is a one, then a one is produced by the AND gate 50. This causes the OR gate 44 to generate a one so that the value in the incrementer 41 is incremented to round the result. If the circuitry is in mode [0] and the input address bit two is a zero (indicating an even address), no increment signal is produced by the AND gate 50; and the pixel value is truncated. Thus, a constant one at the mode[0] input causes the AND gate 50 to generate a signal which increments every other pixel (if required by the value of the least significant data bits) and truncates the pixels between to produce the pattern of FIG. 2.

If the circuitry is placed in mode [1] (four-by-four dither mode) by a one value at the mode[1] input, address bit two or bit three is a one, and the upper two bits of the low order three bits of the red component are ones, an incrementing signal is produced by the AND gate 51. A one appears in at least one of the two address bits in three out of the four addresses of a repeating sequence of four addresses. Thus, if in mode [1] the upper two of the three data bits which are dropped are both ones, three of the four addresses in sequence will cause gate 51 to generate a one. Thus, the AND gate 51 generates incrementing signals for three out of four bits in mode [1] when upper two of the three data bits which are dropped are both ones. This is a 75% rounding pattern and when generated constantly has the same effect as that in the left hand diagram of FIG. 3.

If the circuitry is in mode [1], the address bit two is one, the upper bit of the three least significant bits is one, and the second of the three least significant bits is zero, then an incrementing signal is produced by the AND gate 52. Thus, when only the upper one of the three dropped data bits is a one in mode [1], every other pixel address is incremented. This is the 50% roundup shown in lines two and three of both patterns in FIG. 3.

Finally, if the circuitry is in mode [1], the address bit two is zero, and the address bit three is a one while the upper bit of the three least significant data bits is zero and the second bit is one, then an incrementing signal is produced. In this case only the second of the three least significant data bits is a one, and only every fourth pixel is incremented. In those cases in which an incrementing signal is not produced, the value is truncated. Moreover, by furnishing a zero to both mode [0] and [1] input terminals, an entire line of truncated signals may be produced. In this manner, the different patterns illustrated in the FIGS. 2 and 3 and many additional patterns allowed by the intermixing of the various rounding patterns (including the 75% and 25% rounding patterns) may be produced.

Although the present invention has been described in terms of a preferred embodiment, it will be appreciated that various modifications and alterations might be made by those skilled in the art without departing from the spirit and scope of the invention. For example, an eight-by-eight dither mode could be used, or the conversion could be from fifteen bit per pixel color to twelve bit per pixel color. The invention should therefore be measured in terms of the claims which follow.

What is claimed is:

1. An apparatus for converting representations of color pixels in a twenty-four bit color format to representations in a fifteen bit color format comprising an individual circuit for each color component in a first format having eight bits, each of said individual circuits comprising:

a decision circuit having a first input and a second input and an output such that said first input is coupled to a first input of said individual circuit and said second input is coupled to a second input of said individual circuit, said first input of said decision circuit receives lowest order bits of a color component in said first format wherein said decision circuit is responsive to a value of said lowest order bits indicating whether five highest order bits of said color component should be incremented, said second input of said decision circuit receives a plurality of pixel address bits identifying a pixel location of said color component wherein said pixel location, depending on a desired pattern of pixels, selectively enables said decision circuit to be responsive to said value of said lowest order bits;

an incrementer circuit having a first input and a second input and an output such that said second input is coupled to said output of said decision circuit and said output of said incrementer circuit is coupled to said output of said individual circuit, said first input of said incrementer circuit receives said five highest order bits of said color component in said first format, said second input receives a signal from said output of said decision circuit wherein said signal selectively enables said incrementer circuit to increment said five highest order bits of said color component in said first format, said output of said incrementer circuit provides data representing said color component in a second format having five bits which has been selectively incremented, said output of said individual circuit truncates said lowest order bits after said decision circuit selectively enables said incrementer circuit.

2. An apparatus of claim 1, wherein said decision circuit selectively enables said incrementer circuit to round every other pixel along a row of pixels.

3. An apparatus of claim 1, wherein said decision circuit selectively enables said incrementer circuit to round every fourth pixel along a row of pixels.

4. An apparatus of claim 1, wherein said decision circuit selectively enables said incrementer circuit to round three of every four pixels along a row of pixels.

5. An apparatus of claim 1 further comprises a comparator circuit having an input and an output wherein said input is coupled to receive said five highest order bits and said output is coupled to a third input of said decision circuit, said comparator circuit disables said decision circuit when said five highest order bits of said color component in said first format are all ones.

6. An apparatus of claim 1, wherein said decision circuit is able to select patterns repeating every two and every four pixels.

7. An apparatus of claim 2 further comprising an odd number of pixels to be displayed on each horizontal row of a display.

8. An apparatus for converting representations of color pixels in one color format to representations in another color format comprising an individual circuit for data representing each component of a color, each of said individual circuits comprising:

a decision circuit having a first input and a second input and an output such that said first input is coupled to a first input of said individual circuit and said second input is coupled to a second input of said individual circuit, said first input of said decision circuit receives lowest order bits of a color component wherein said decision circuit is responsive to a value of said lowest order bits indicating whether five highest order bits of said color component should be incremented, said second input of said decision circuit receives a plurality of pixel address bits identifying a pixel location of said color component wherein said pixel location, depending on a desired pattern of pixels, selectively enables said decision circuit to be responsive to said value of said lowest order bits;

an incrementer circuit having a first input and a second input and an output such that said second input is coupled to said output of said decision circuit and said output of said incrementer circuit is coupled to said output of said individual circuit, said first input of said incrementer circuit receives said five highest order bits of said color component, said second input receives a signal from said output of said decision circuit wherein said signal selectively enables said incrementer circuit to increment said highest order bits of said color component, said output of said incrementer circuit provides data representing said color component which has been selectively incremented, and wherein said lowest order bits are not provided as output from said individual circuit.

9. An output display apparatus for a computer system comprising:

a conversion circuit having a data input coupled to a first input of said output display apparatus and a data output, said conversion circuit further having a first translator wherein said first translator converts color pixel data in a first format having a first number of bits to said color pixel data in a second format having a lesser number of bits for each color component of each pixel to be displayed;

a memory circuit having a first input coupled to said data output of said conversion circuit and a second input coupled to receive an address and an output, said memory circuit storing said color pixel data in said second format, said memory circuit further comprising a shifter wherein said shifter changes an address of said pixel data to be stored;

a display device having an input coupled to said output of said memory circuit, said display device displaying said color pixel data in said second format stored by said memory circuit, and wherein said conversion circuit has a second translator wherein said second translator converts said color pixel data in said second format to said color pixel data in said first format to be displayed, and wherein said first translator in said conversion circuit converts representations of color pixels in a twenty-four bit color format to representations in a fifteen bit color format comprising an individual circuit for data representing each component of a color, each of said individual circuits comprising:

a decision circuit having a first input and a second input and an output such that said first input is coupled to a first input of said individual circuit and said second input is coupled to a second input of said individual circuit, said first input of said decision circuit receives lowest order bits of a color component wherein said decision circuit is responsive to a value of said lowest order bits indicating whether five highest order bits of said color component should be incremented, said second input of said decision circuit receives a plurality of pixel address bits identifying a pixel location of said color component wherein said pixel location, depending on a desired pattern of pixels, selectively enables said decision circuit to be responsive to said value of said lowest order bits;

an incrementer circuit having a first input and a second input and an output such that said second input is coupled to said output of said decision circuit and said output of said incrementer circuit is coupled to said output of said individual circuit, said first input of said incrementer circuit receives said five highest order bits of said color component, said second input receives a signal from said output of said decision circuit wherein said signal selectively enables said incrementer circuit to increment said five highest order bits of said color component which has been selectively incremented, said output of said incrementer circuit provides data representing said color component.

10. An output display apparatus of claim 9 wherein said decision circuit selectively enables said incrementer circuit to round every other pixel depending on said desired pattern of pixels.

11. An output display apparatus of claim 9 further comprises a comparator circuit having an input and an output wherein said input is coupled to receive said five highest order bits and said output is coupled to a third input of said decision circuit, said comparator circuit disables said decision circuit when said five highest order bits of said color component in said first format are all ones.

12. An output display apparatus of claim 9 wherein said decision circuit is able to select patterns repeating every two and every four pixels.

13. An output display apparatus of claim 10 further comprising an odd number of pixels to be displayed on each horizontal row of a display.

* * * * *